US006357185B1

(12) United States Patent
Obermeyer et al.

(10) Patent No.: US 6,357,185 B1
(45) Date of Patent: Mar. 19, 2002

(54) RAFTER AIR INFILTRATION BLOCK

(75) Inventors: Keith G. Obermeyer, Hamel; James S. Andrews, Medina; David Wayne Koch, Coon Rapids; John R. Twardy, Monticello; Mark H. Theno, Minnetonka, all of MN (US)

(73) Assignee: Ado, Inc.

( * ) Notice: Subject to any disclaimer, the term of this patent is extended or adjusted under 35 U.S.C. 154(b) by 0 days.

(21) Appl. No.: 09/721,274

(22) Filed: Nov. 22, 2000

Related U.S. Application Data

(60) Provisional application No. 60/169,331, filed on Dec. 6, 1999.

(51) Int. Cl.[7] ..... E04B 7/18; F24F 7/02; E04D 13/17

(52) U.S. Cl. ..... 52/95; 52/302.1

(58) Field of Search ..... 52/94, 95, 199, 52/302.1, 302.3, 317, DIG. 15

(56) References Cited

U.S. PATENT DOCUMENTS 3,863,553 A * 2/1975 Koontz ..... 52/95 X
4,102,092 A * 7/1978 Ward ..... 52/95
4,125,971 A * 11/1978 Ward ..... 52/95
4,125,982 A * 11/1978 Ward ..... 52/404.1
4,151,894 A 5/1979 Edwards
4,185,433 A 1/1980 Cantrell
4,189,878 A * 2/1980 Fitzgerald ..... 52/95
4,197,683 A * 4/1980 Ward ..... 52/95
4,214,510 A * 7/1980 Ward ..... 52/95 X
4,502,368 A 3/1985 Hempel
4,567,074 A 1/1986 Litaker
4,581,861 A 4/1986 Eury
4,611,443 A * 9/1986 Jorgensen et al. ..... 52/95
4,658,555 A 4/1987 Steiner
5,007,216 A * 4/1991 Pearson ..... 52/94
5,341,612 A * 8/1994 Robbins ..... 52/95
6,112,490 A * 9/2000 Meyer ..... 52/95 X

* cited by examiner

*Primary Examiner*—Laura A. Callo
(74) *Attorney, Agent, or Firm*—Vidas, Arrett & Steinkraus PA.

(57) ABSTRACT

A rafter air infiltration block for use in house construction to prevent loss of blown-in insulation and to prevent air infiltration between the outside and the trusses. A generally rectangular piece of stiff, waterproof material has a plurality of fold lines to allow the block to be readily placed where desired in a variety of different settings and to conform to a roof vent.

8 Claims, 6 Drawing Sheets

10
52
54
56
58
60
62
64
66
68
70
72
74
78
80
82
84
86
88
90
92
94
96
100
102

RAFTER AIR INFILTRATION BLOCK

CROSS-REFERENCE TO RELATED APPLICATIONS

This application is a utility application claiming priority from provisional application No. 60/169,331, filed Dec. 6, 1999, the entire contents of which are incorporated herein by reference.

STATEMENT REGARDING FEDERALLY SPONSORED RESEARCH

Not Applicable

BACKGROUND OF THE INVENTION

This invention relates to a rafter air infiltration block which partially blocks the openings which connect an attic space and the overhanging eaves. It prevents air infiltration except through a roof rafter vent and prevents a loss of blown-in insulation.

Originally, insulation was rarely used in housing as energy costs were low. As houses began to be more heavily insulated, building codes developed to ensure that the homeowner would have a properly insulated home. Soffit or rafter vents chutes were developed to work with blown in insulation which otherwise completely blocks air circulation from the eaves into the attic. While these worked very well, a continuing problem area is in how to properly block the area under the vent chutes that leads to the eaves. These areas are referred to as "cold comers" or "wind wash" where the wind may pass up through the soffit vents and reach the uninsulated wood, causing a very cold spot that reaches into the residence area.

Standard trusses account for about 90% of all roof trusses. They may be of a single height where a gusset plate attaches a 2 by 4 to an angled truss to form the roof line. In such a case, a single height gap of about two inches is left. The other main truss type uses a wedge block that causes a double height gap to exist which needs to be sealed.

Typical solutions to this problem are shown by Eury, U.S. Pat. No. 4,581,861 which discloses a stiff sheet having multiple tabs that may be folded in place. Cantrell, U.S. Pat. No. 4,185,433 shows another baffle board construction using a sheet of stiff, scored material which may be folded in place. Finally, some constructions have attempted to combine a vent chute with a baffle board as shown by Pearson, U.S. Pat. No. 5,007,216.

Builders use anything from specially cutting exterior sheathing to fill the gap and then sealing the gaps left with a sealant or manually cut pieces to fit each gap. Batting is also sometimes folded and stuffed into the space but is prone to getting wet and rotting.

An acceptable air infiltration device needs to be easily installed and should be usable in a variety of truss arrangements and vent chute configurations.

The art described in this section is not intended to constitute an admission that any patent, publication or other information referred to herein is "prior art" with respect to this invention, unless specifically designated as such. In addition, this section should not be construed to mean that a search has been made or that no other pertinent information as defined in 37 C.F.R. §1.56(a) exists.

BRIEF SUMMARY OF THE INVENTION

The invention provides an air infiltration block that provides an air impermeable barrier that is water resistant and is installed readily with or without a wide variety of vent chutes and with most existing roof trusses. The single rafter block of the invention may be used in many different configurations due to its unique features. It is formed from a sheet of water-resistant material such as a waxed paper or cardboard and includes a plurality of fold lines, slits, perforation lines and tabs to allow it to function with the majority of factory truss and vent chute designs without cutting. A single block design may be ordered and stocked that will cover all jobs rather than multiple blocks, each of which accommodate a different truss or vent chute design and size.

BRIEF DESCRIPTION OF THE SEVERAL VIEWS OF THE DRAWINGS

A detailed description of the invention is hereafter described with specific reference being made to the drawings in which.

DETAILED DESCRIPTION OF THE INVENTION

Figure 1:
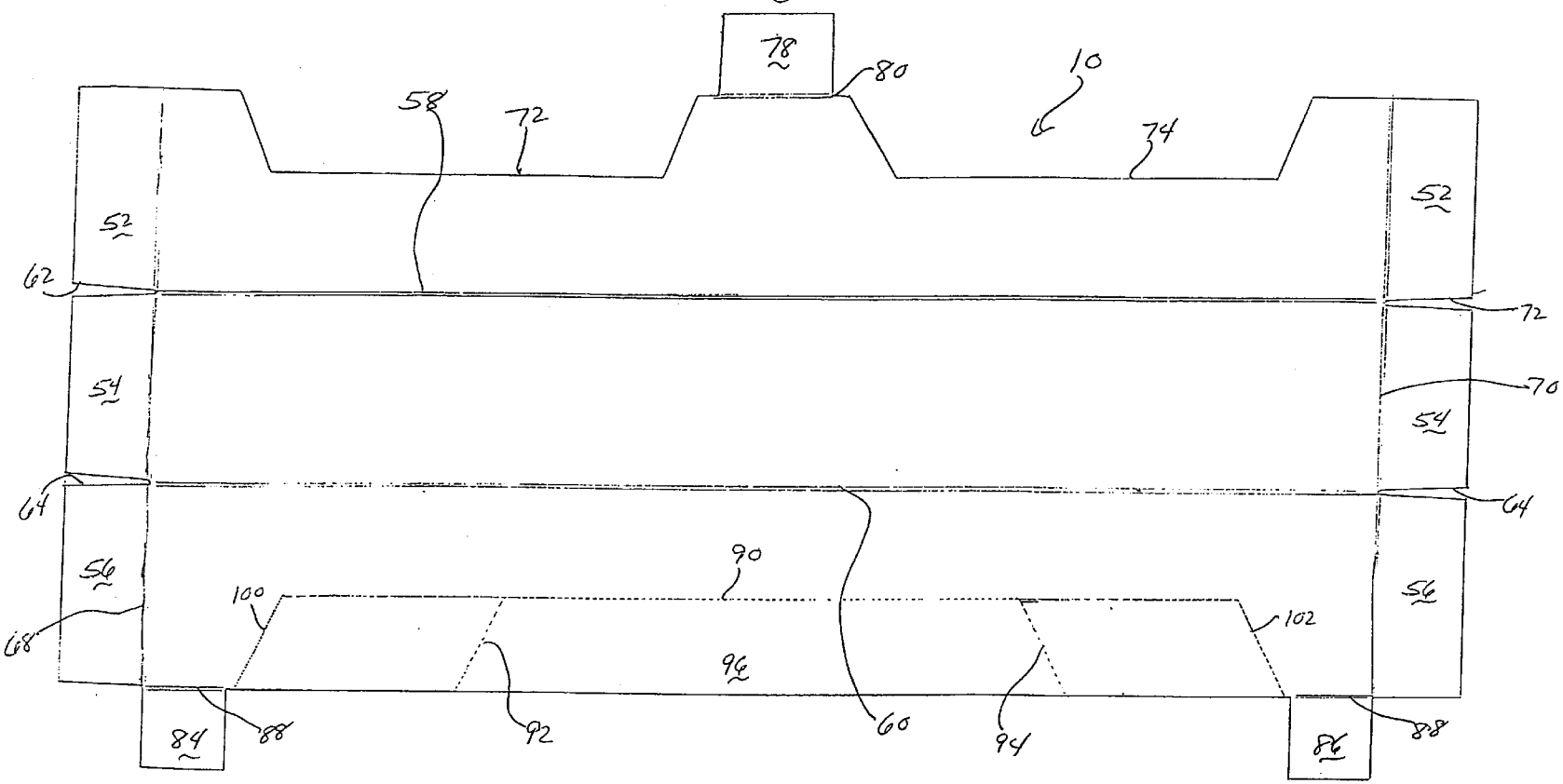
FIG. 1 is a plan view of the rafter block prior to folding.
Figure 2:
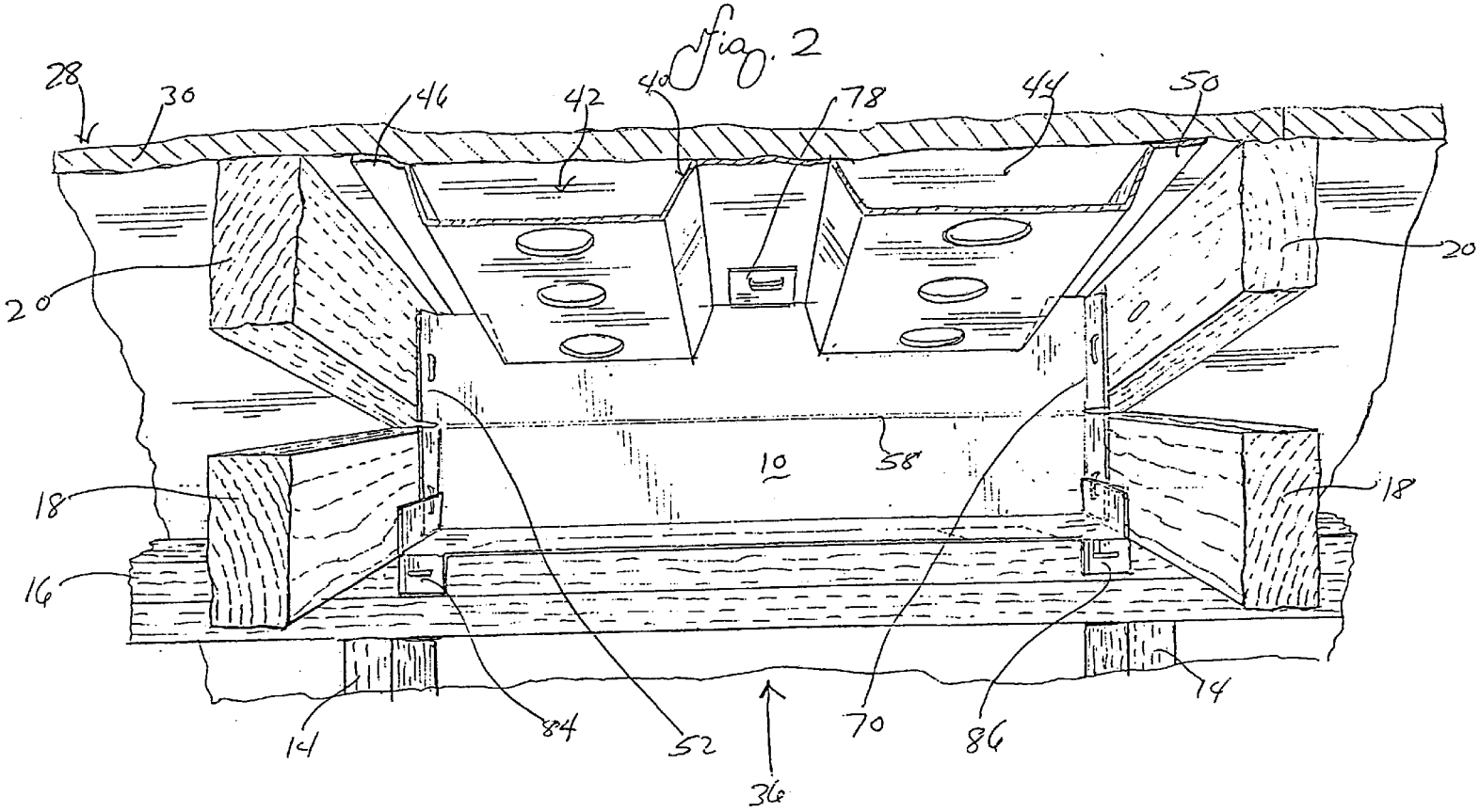
FIG. 2 is a perspective view illustrating the rafter block mounted in a truss roof.
Figure 3:
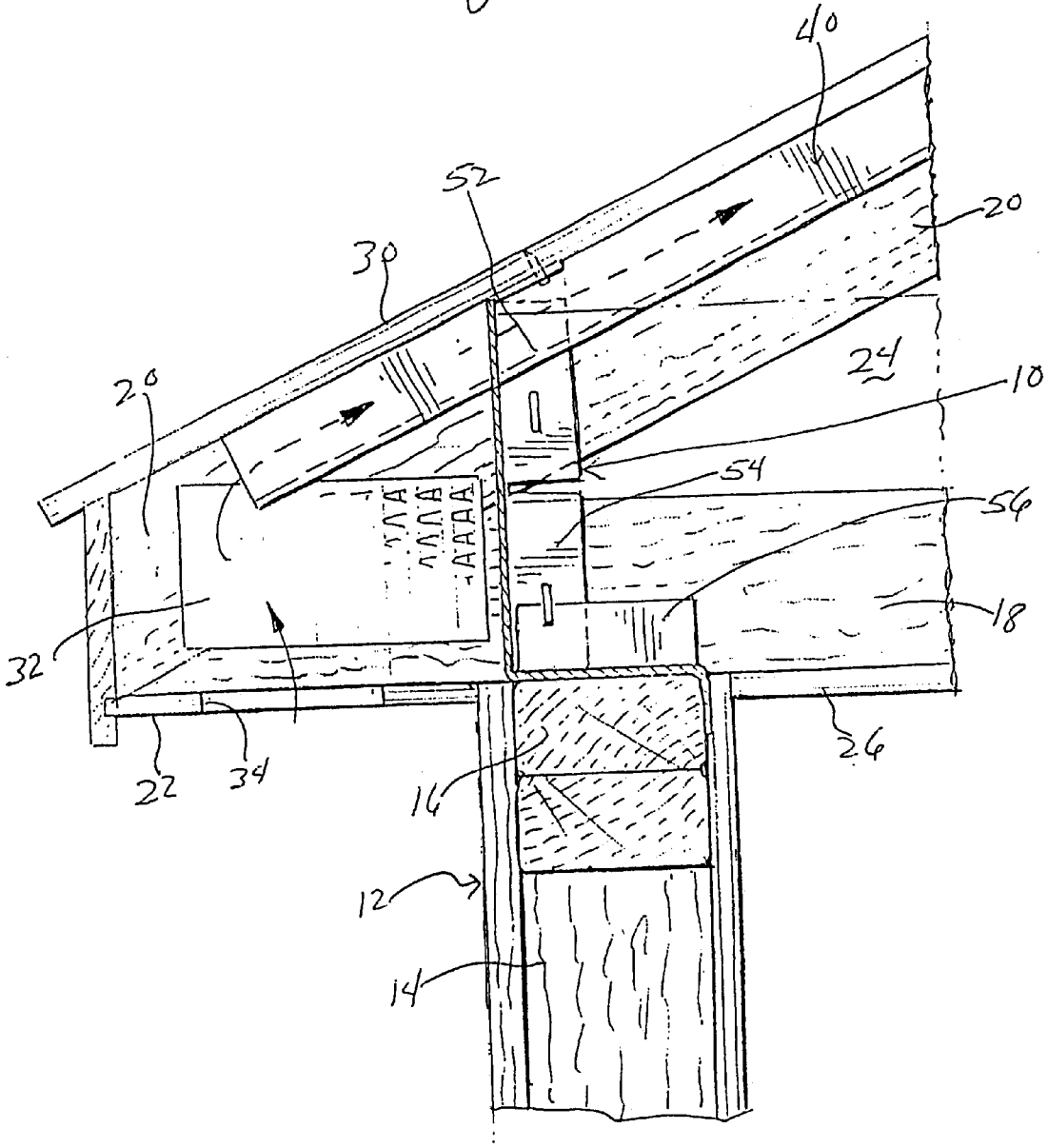
FIG. 3 is a sectional view of the structure of FIG. 2 taken along line 2—2 thereof.
Figure 4:
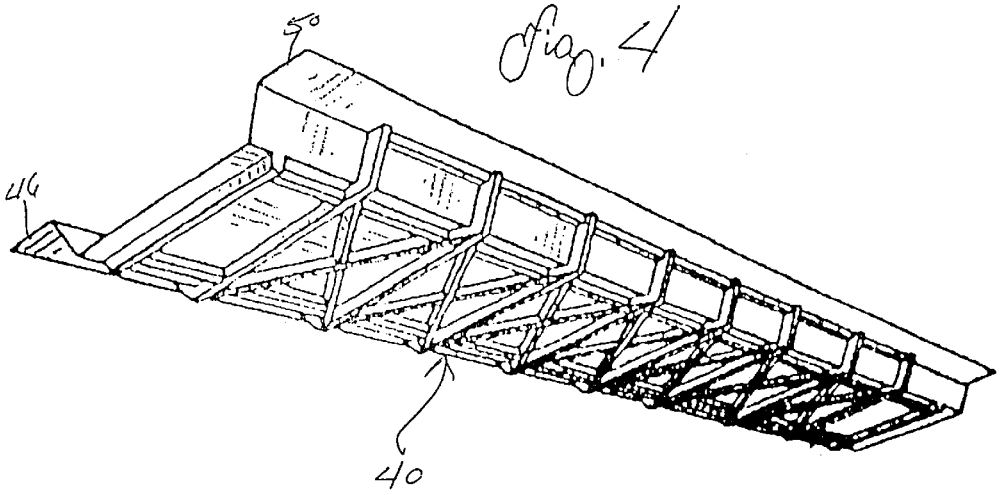
FIG. 4 is a perspective view of a typical rafter vent.
Figure 5:
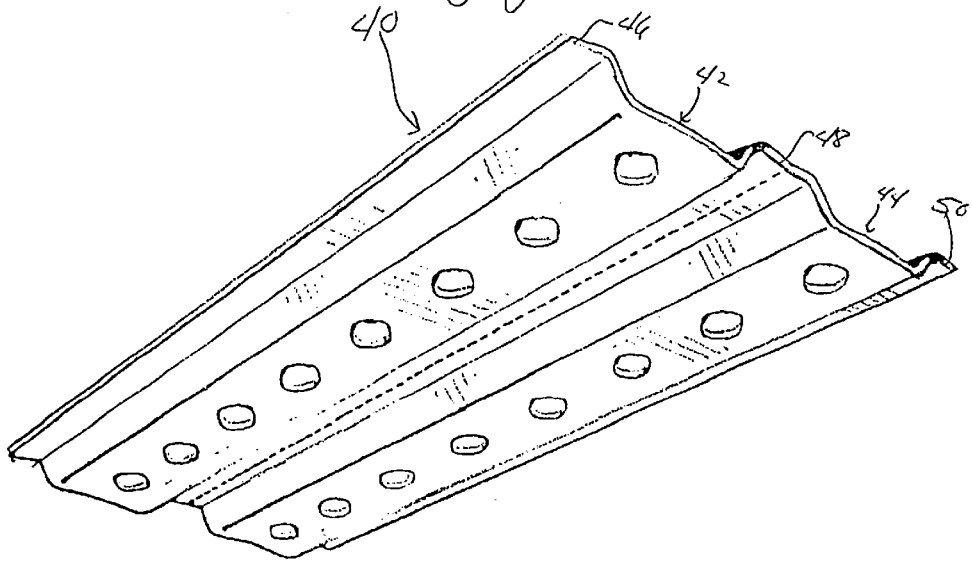
FIG. 5 is a perspective view of another typical rafter vent.

With reference to the figures, the air infiltration block 10 of FIG. 1 is shown installed in an attic space 24 of a building which has upstanding walls 12 including vertical studs 14, a horizontal top plate 16, joists 18 and roof rafters 20 which together form a roof 28 to which roof sheathing 30 may be secured as shown in FIGS. 2 and 3.

The ceiling joists 18 and roof rafters 20 come together and are joined in the area of the top plate 16. The figures depict a typical truss roof in which connector plates 32 are used to join the rafters 20 to the joists 18. As shown, the roof rafters 20 extend beyond the wall 12 to form an overhang and underlying eaves 22. The eaves 22 include openings 34 through which outside air is intended to flow into the attic space 24.

Figure 6:
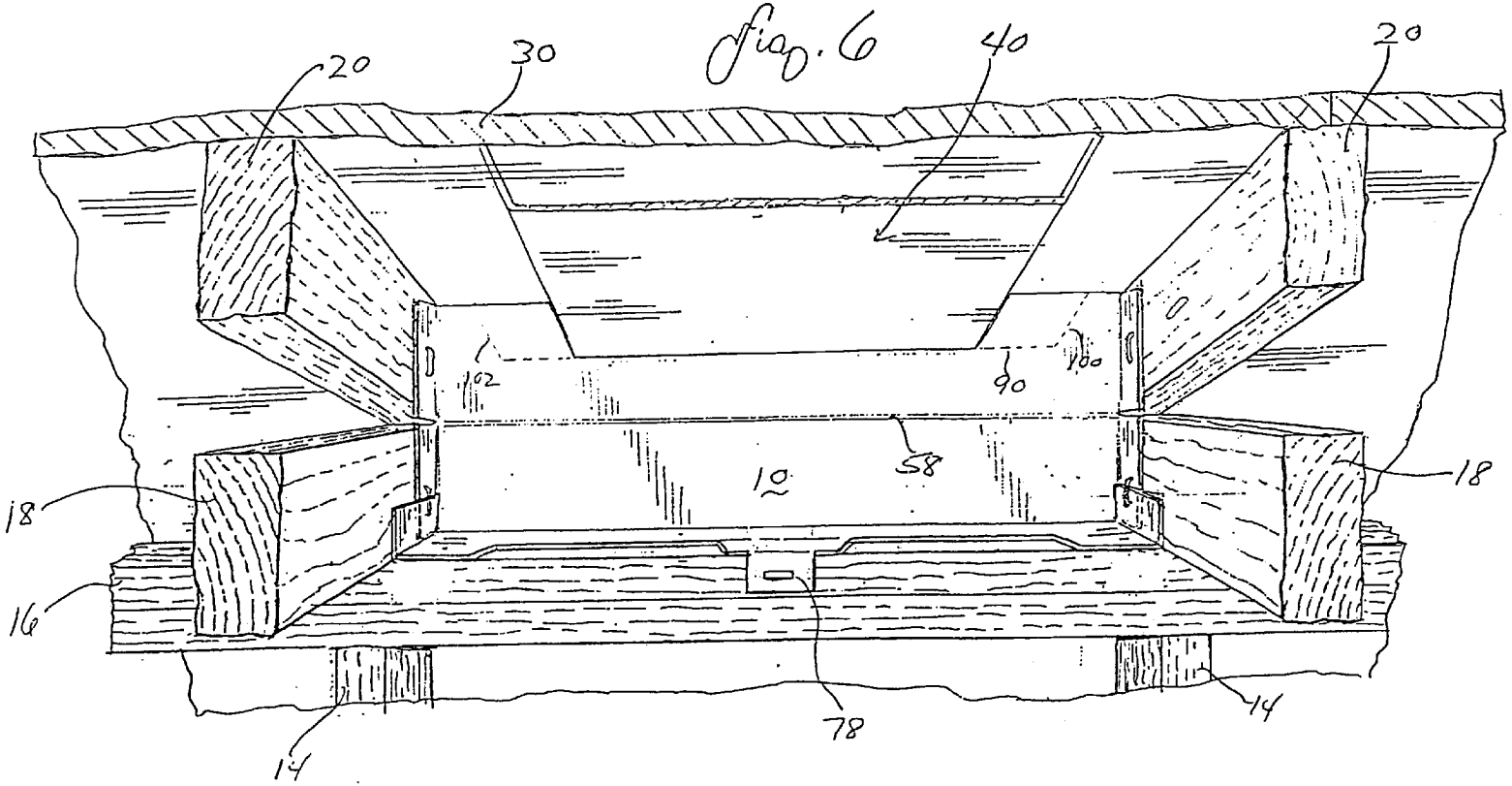
FIG. 6 is a perspective view of the rafter block of the invention oriented differently with a different rafter vent.
Figure 7:
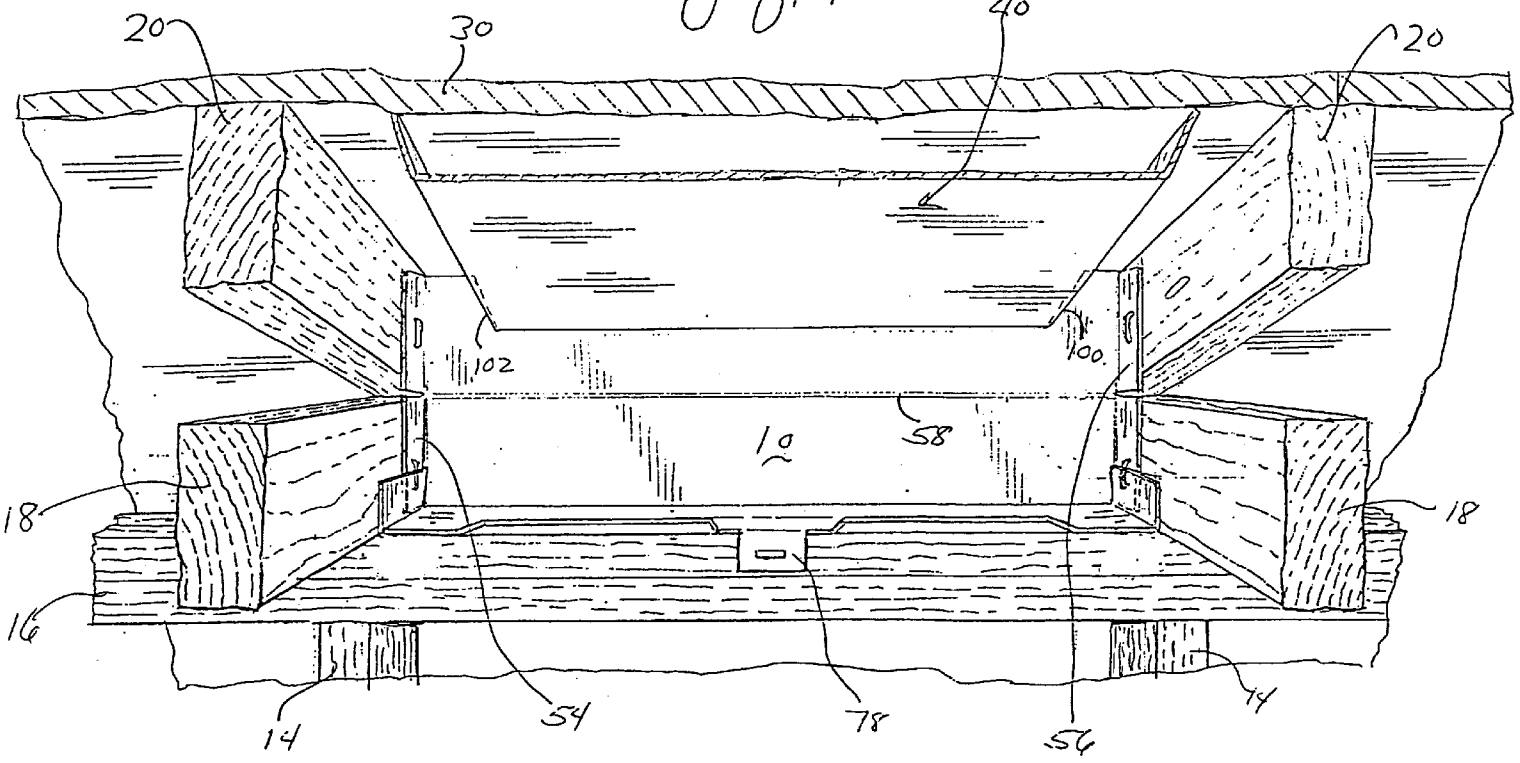
FIG. 7 is a perspective view of the rafter block of the invention oriented differently with a different sized rafter vent.

The adjacent pairs of ceiling joists 18 and roof rafters 20, together with the roof sheathing 30 and ceiling wallboard 26 define openings 36 shown in FIGS. 2, 6 and 7 complete with a rafter air infiltration block 10 and a vent chute 40. Ordinarily, insulation, which may be batting or blown-in, is on top of the ceiling wallboard 26 to at least the depth of the joists 18.

Proper ventilation in an attic is essential to allow removal of excess heat in summer and to deal with moisture. However, extremely cold air should not be allowed to contact any non-insulating member such as the top plate 16 or cold spots inside the house are formed. In addition, air flow in and out of the attic space 24 needs to be directed and controlled to prevent loss of insulation and waterlogging of the insulation due to water passing up into the eaves.

Ideally, a vent chute 40 is secured to the underside of the roof sheathing 30 as shown in FIGS. 2, 6 and 7. Vent chutes

40 provide a controlled path for air flow in and out of the attic through the eaves. Since vent chutes are water resistant and angle upwardly, they prevent water from reaching the insulation. However, absent an air infiltration block 10 of the invention, water and insulation may pass under the vent chutes in and out of the eave 22 area.

As may be seen from the FIGS., the ends of the joists and rafters creates a small space which is difficult for installers to reach. The vent chutes 40 are relatively long, and as shown in FIG. 2 may be molded to define two separate channels 42, 44 between horizontal flanges 46, 48 and 50 which are tacked to the roof sheathing 30 with a staple gun or the like. The vent chute of FIG. 2 is typically 22 inches in width, illustrating how narrow the space is in which the installers must work.

Once in the narrow confines of the attic opening 34 between the adjacent rafters and joists an installer should place some form of block to prevent a loss of insulation into the eaves 22 below the vent chutes 40 and to make an air infiltration seal such that air is forced away from the wall top plate 16.

The air infiltration block 10 of the invention is constructed of a sheet stock of stiff, waterproof material, such as a waxed paperboard. The waterproofing limits any damage and loss of function which would occur if simple cardboard was used. As shown in FIG. 1, the block 10 is generally rectangular in shape, and includes a longitudinal fold line 58 which corresponds to a standard truss construction and a longitudinal fold line 60 which is adapted to work in roofs employing a wedge or raised heel truss. At the ends of the fold lines 58, 60, the block 10 is slitted or cut at regions 62, 64 from fold lines 68, 70 which are spaced from the ends and intersect the longitudinal fold lines 58, 60 at right angles. The ends of each define three separate tabs 52, 54 and 56 as shown in FIG. 1.

The area above fold line 58 on the block 10 has an outer edge that defines two channels 72, 74 which are constructed and arranged to snugly mate with the channels 42, 44 of a two-channel vent chute 40 as shown in FIG. 2. Channels 72, 74 are separated by an upstanding tab 78 which may be folded down along fold line 80 such that the tab 78 may be stapled through the vent chute flange 48 into the roof sheathing 30.

The area below fold line 60 of the block 10 has an outer edge 82 that includes a pair of tabs 84, 86 which extend beyond the outer edge 82 at its ends and include a fold line 88 which allows the tabs to bend as desired for stapling to the top plate 16. The block 10 of the invention also may include a perforation line 90 that allows all of a portion of the outer edge 82 between the tabs 84, 86 to be removed. Removal of the sheet defined by perforation line 90 and perforation lines 92, 94 creates a narrow, single channel 96 which mates with a vent chute 40 having only a single channel as shown in FIG. 6. For larger single channel vent chutes as shown in FIG. 7, the portion of the outer edge 82 between tabs 84, 86 between perforation line 90 and perforation lines 100, 102 may be removed to form a larger channel. It should be apparent that the block 10 is simply inverted 180 degrees such that channel 96 is placed up toward the vent chutes 40 when a single channel vent chute 40 is to be used. Thus, a single block 10 of the invention may be quickly adapted in the field to work with either a single or double channel vent chute 40 without requiring any tools.

Use of the inventive air infiltration blocks 10 is very simple. For the truss layout as depicted in FIG. 2, a block 10 is used as is, and the installers simply bends the block at fold line 60, bends in each of the tabs 52, 54 and 56 to a right angle and inserts the block tightly up against the vent chute 40 such that the vent chute channels 42, 44 mate with the channels 72, 74 of the block 10. Tab 78 is bent forward and attached to the roof sheathing 30 by a staple or the like. Likewise, each of tabs 52, 54 and 56 may be tacked or stapled to the joists 18 and rafters 20 as shown. In addition, tabs 84 may be secured to the top plate 16. Together, the block forms a tight water resistant seal exactly where needed to prevent insulation loss, moisture wicking into the insulation and to prevent cold spots due to air infiltration where it is not desired.

With reference to FIG. 6, the block 10 is simply inverted, and channel 96 is formed by removing the sheet defined by lines 90, 92 and 94. The tabs are then folded as before and the block is slid into a tight sealing engagement with the vent chute 40. A stapler or tacker may then secure the block in place at several or all of the tabs, depending on the ease of reaching each tab.

With reference to FIG. 7, the block 10 is inverted as above, but the channel 96 is made larger by removing the sheet defined by lines 90, 100 and 102 to fit the larger sized vent chute. The block 10 is then secured as previously described. Note that all examples show a truss system of double height. A single height truss design would simply involve using fold line 58 as the interfacing line abutting against the top plate 16 instead of fold line 60 as shown.

As described above and shown in the figures, the single air infiltration block of the invention is usable in double and single-height roof trusses, will work with different vent chute sizes and configurations and is water resistant to prevent loss of integrity when rain water reaches it up through the eaves 22. It may be installed without a need for a scissors and simply requires inversion or a removal of excess sheet stock at the perforation lines.

In addition to being directed to the embodiments described above and claimed below, the present invention is further directed to embodiments having different combinations of the features described above and claimed below. As such, the invention is also directed to other embodiments having any other possible combination of the dependent features claimed below.

The above examples and disclosure are intended to be illustrative and not exhaustive. These examples and description will suggest many variations and alternatives to one of ordinary skill in this art. All these alternatives and variations are intended to be included within the scope of the attached claims. Those familiar with the art may recognize other equivalents to the specific embodiments described herein which equivalents are also intended to be encompassed by the claims attached hereto.

What is claimed is:

1. A rafter air infiltration block comprising:

a generally rectangular sheet of water-resistant material defining an upper and lower edge and left and right sides, a first longitudinal fold line extending the full length of the block between the left and right sides, a transverse fold line adjacent the left and right sides spaced therefrom and intersecting said first longitudinal fold line, said first longitudinal fold line being cut through said material to form a slit between said right side to said right side transverse fold line, and being cut through said material to form a slit between said left side to said left side transverse fold line, said upper edge including a pair of spaced indentations toward said first longitudinal fold line which conform in shape to a double channel vent chute, said lower edge including score lines to allow ready removal of a portion of the sheet along the lower edge in order to form a single indentation which conforms to the shape of a single channel vent chute.

2. The rafter air infiltration block of claim 1 wherein said upper edge includes at least one tab member.

3. The rafter air infiltration block of claim 2 wherein the at least one tab member constructed and arranged to be folded so as to attach to a roof structure.

4. The rafter air infiltration block of claim 1 wherein said lower edge includes at least one tab member.

5. The rafter air infiltration block of claim 4 wherein the at least one tab member constructed and arranged to be folded so as to attach to a roof structure.

6. The rafter air infiltration block of claim 1 wherein said upper edge and said lower edge each include at least one tab member, the at least one tab member constructed and arranged to be folded so as to attach to a roof structure.

7. The rafter air infiltration block of claim 1 further including a second longitudinal fold line spaced from said first longitudinal fold line at a distance approximating the thickness of a top plate in a building wall.

8. The rafter air infiltration block of claim 1 wherein said lower edge includes multiple score lines to allow ready removal of a portion of the sheet along the lower edge to conform to either a narrower or a wider single channel vent chute.

* * * * *